US005724053A

United States Patent [19]

Nagakubo

[11] Patent Number: 5,724,053

[45] Date of Patent: Mar. 3, 1998

[54] PLASMA DISPLAY APPARATUS ADAPTED TO MULTIPLE FREQUENCIES

[75] Inventor: Tetsuroh Nagakubo, Koufu, Japan

[73] Assignee: Pioneer Electronic Corporation, Tokyo, Japan

[21] Appl. No.: 504,243

[22] Filed: Jul. 19, 1995

[30] Foreign Application Priority Data

Sep. 7, 1994 [JP] Japan ..... 6-213934

[51] Int. Cl.[6] ..... G09G 3/28

[52] U.S. Cl. ..... 345/60; 345/213

[58] Field of Search ..... 345/60, 63, 89, 345/213, 212, 211, 147, 148, 149; 315/169.4, 169.3

[56] References Cited

U.S. PATENT DOCUMENTS 5,231,382 7/1993 Tanaka ..... 345/60

5,266,940 11/1993 Shiraishi ..... 345/148

5,475,448 12/1995 Saegusa ..... 345/63

5,541,618 7/1996 Shinoda ..... 345/60

*Primary Examiner*—Xiao Wu

*Attorney, Agent, or Firm*—Sughrue, Mion, Zinn, Macpeak & Seas, PLLC

[57] ABSTRACT

A plasma display apparatus is adapted to operate with more than one scanning frequency. The display of images is performed in a state where the luminance level is maintained constant even when a vertical scanning frequency of a video signal changes. A luminance of a whole display image is held constant by adjusting the number of times of the discharge light emission of a plasma display panel. This adjustment is performed in accordance with the vertical sync frequency of the video signal supplied.

1 Claim, 6 Drawing Sheets

FIG. 4

| SF 1 | SF 2 | SF 3 | SF 4 | SF 5 | SF 6 | SF 7 | SF 8 | TOTAL |
|---|---|---|---|---|---|---|---|---|
| 2048 | 1024 | 512 | 256 | 128 | 64 | 32 | 16 | 4080 |

FIG. 5

| SF 1 | SF 2 | SF 3 | SF 4 | SF 5 | SF 6 | SF 7 | SF 8 | TOTAL |
|---|---|---|---|---|---|---|---|---|
| 1706 | 853 | 427 | 213 | 107 | 53 | 27 | 13 | 3399 |

PLASMA DISPLAY APPARATUS ADAPTED TO MULTIPLE FREQUENCIES

BACKGROUND OF THE INVENTION

1. Field of the Invention

The invention relates to a plasma display apparatus and, more particularly, to a plasma display apparatus adapted to operate with multiple scanning frequencies.

2. Description of Background Information

Various studies have been performed in recent years on plasma displays (hereinafter, referred to as a PDP) and electroluminescence displays (hereinafter, referred to as an ELD) as electronic display devices, for a thin shape two-dimensional image display apparatus.

In a display apparatus using a light emitting device having only two states i.e. a light emitting state and a non-light emitting state, such as a PDP or an ELD, a luminance gradation display is executed so as to obtain a halftone luminance corresponding to a supplied video signal.

In such a display apparatus, when a vertical scan frequency of the supplied video signal changes, the luminance level of the whole display image changes in accordance with such a frequency change. This results in a problem that a stable image display is achieved when designing the display apparatus to accept plural scanning speeds.

OBJECTS AND SUMMARY OF THE INVENTION

The invention has been made to solve the above-described problem and it is an object of the invention to provide a plasma display apparatus adapted to multiple scanning frequencies which can stably display an image in which a luminance level doesn't change even if a vertical scan frequency of a video signal changes.

According to the present invention, there is provided a plasma display apparatus adapted to multiple scanning frequencies in which a video signal is divided to a plurality of pixel data according to a luminance level for every field. The number of times of discharge light emission corresponding to each of the pixel data is set in accordance with the level of luminance and a gradation display is performed by executing a light emission drive. The apparatus comprises vertical sync frequency measuring means for measuring a vertical sync frequency of the video signal and discharge light emission adjusting means for adjusting the number of times of the discharge light emission on the basis of the vertical sync frequency.

The luminance of the whole display image is held constant by adjusting the number of times of the discharge light emission of the plasma display panel in accordance with the vertical sync frequency of the video signal supplied.

BRIEF DESCRIPTION OF THE DRAWINGS

FIG. 4 is a diagram for explaining the operation of an erasing pulse timing generating circuit 74;

FIG. 5 is a diagram for explaining the operation of an erasing pulse timing generating circuit 75;

DETAILED DESCRIPTION OF THE PREFERRED EMBODIMENT

Prior to explaining an embodiment in detail, the operation of a conventional plasma display panel will be first described in detail with reference to the drawings.

Figure 1:
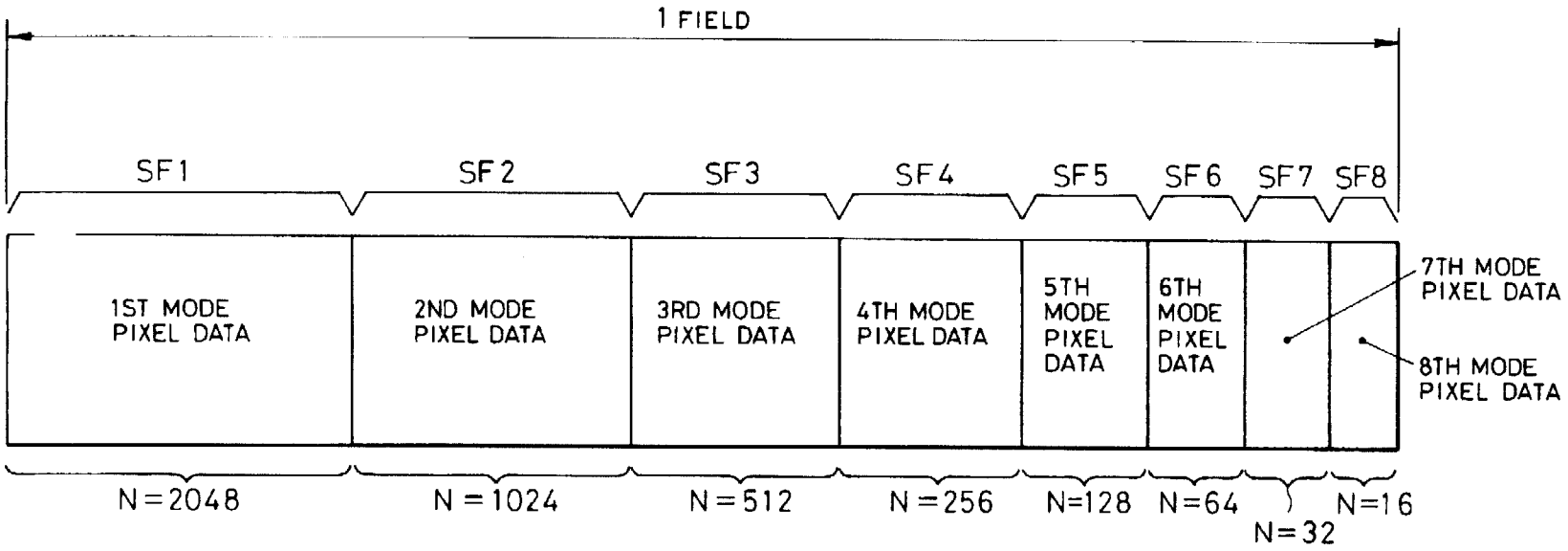
FIG. 1 is a diagram for explaining a display operation of 256 luminance gradations by a conventional plasma display apparatus.

FIG. 1 is a diagram showing an example of the operation when a gradation display of luminance is executed at 256 levels.

As shown in FIG. 1, in such a 256 luminance gradation display operation, one field of a video signal supplied is divided into eight subfields of a first subfield SF1 to an eighth subfield SF8. Further, such a 1-field video signal is weighted to eight stages in its luminance component for every one field of the video signal, thereby separating the signal into first mode pixel data to eighth mode pixel data, respectively. In this instance, the first mode pixel data corresponds to the highest luminance component. As the degree of such a mode rises, the weight of the high luminance component decreases. Namely, the eighth mode pixel data corresponds to the lowest luminance component in the 1-field video signal.

Each of the first to eighth mode pixel data is allocated to each of the first to eighth subfields SF1 to SF8 as shown in FIG. 1. The discharge light emitting operations are sequentially executed from the first subfield SF1.

First, in the first subfield SF1, the discharge light emission using the first mode pixel data corresponding to the highest luminance component is repeatedly executed 2048 times. Subsequently, in the second subfield SF2, the discharge light emission using the second mode pixel data of a low luminance that is lower than the first mode pixel data by one rank is repeatedly executed 1024 times. In the third subfield SF3, the discharge light emission using the third mode pixel data of a low luminance that is lower than the second mode pixel data by one rank is repeatedly executed 512 times.

In a manner similar to the above, the discharge light emitting operations are executed in the fourth to eighth subfields SF4 to SF8 while reducing the number (N) of light emission times step by step, thereby executing the display of 256 luminance gradations in one field of the pixel data.

Namely, in the display apparatus using the light emitting device having only two states of light emission and non-light emission such as PDP or ELD, the halftone luminance is obtained in dependence on the number of light emission times.

In recent years, in the display apparatus which is used for a personal computer or the like, an apparatus adapted to multiple scanning frequencies has become desirable. Namely, the vertical scan frequency of a computer image signal which is used in such a personal computer can be arbitrarily selected in accordance with an application which is used for image processes. Even on the display apparatus side, therefore, it is desired that the image display can be performed in correspondence to a change in vertical scan frequency of the computer image signal, namely, what is called a display apparatus adapted to multiple scanning frequencies is desired.

In such a display apparatus like a PDP or ELD as mentioned above, however, when the vertical scan frequency of the video signal which is supplied changes, the luminance level of the whole display image also changes in accordance with a change in vertical scan frequency.

For example, in the gradation display operation shown in FIG. 1, now assuming that one field period of the supplied video signal is equal to 1/60 second, namely, the vertical scan frequency is equal to 60 Hz, when the vertical scan frequency changes to 72 Hz, one field period is equal to 1/72 second and is shorter than that in the case where the vertical scan frequency is equal to 60 Hz. In this instance, since the 1-field period decreases, the number of light emission times per unit time inevitably increases and the luminance level of the whole display image appears to rise.

As mentioned above, in such a display apparatus, when the vertical scan frequency of the supplied video signal changes, the luminance level of the whole display image changes in accordance with such a frequency change, so that a problem arises whereby the image is not stably displayed when the display apparatus is adapted to the multiple scanning frequencies.

An embodiment of the invention will now be described hereinbelow in detail.

Figure 2:
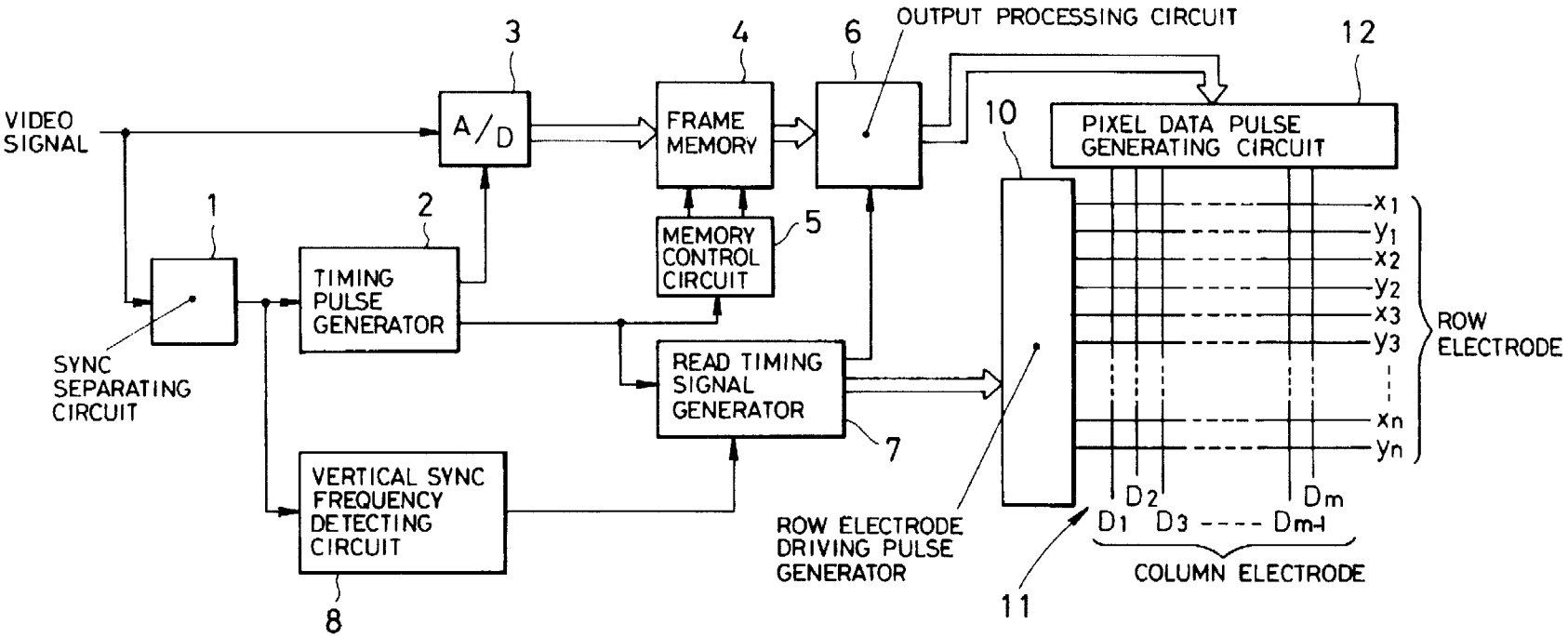
FIG. 2 is a diagram showing a construction of a plasma display apparatus adapted to multiple scanning frequency according to the invention.

FIG. 2 is a diagram showing a construction of a plasma display apparatus adapted to multiple scanning frequencies according to the invention.

In FIG. 2, a sync separating circuit 1 extracts horizontal and vertical sync signals from an input video signal which was inputted and supplies those sync signals to a timing pulse generating circuit 2 and a vertical sync frequency detecting circuit 8, respectively. The timing pulse generating circuit 2 generates an extraction sync signal timing pulse based on those extracted horizontal and vertical sync signals and supplies it to an A/D converter 3, a memory control circuit 5, and a read timing signal generating circuit 7, respectively.

The vertical sync frequency measuring circuit 8 measures a frequency of the vertical sync signal extracted by the sync separating circuit 1 and supplies a vertical sync frequency signal Vf corresponding to the measured frequency to the read timing signal generating circuit 7. The vertical sync frequency measuring circuit 8 has, for instance, a counter for counting clock signals of a predetermined frequency and obtains the vertical sync frequency signal Vf on the basis of a count value obtained by the counter for a period of time between trailing edges of the vertical sync signals which are sequentially supplied from the sync separating circuit 1.

The A/D converter 3 converts the input video signal to digital pixel data corresponding to each pixel synchronously with the extracted sync signal timing pulse and supplies this data to a frame memory 4. The memory control circuit 5 supplies a write signal and a read signal which are synchronized with the extracted sync signal timing pulse to the frame memory 4. In response to such a write signal, the frame memory 4 sequentially fetches each pixel data supplied from the A/D converter 3. In response to the read signal, the frame memory 4 sequentially reads out the pixel data stored in the frame memory 4 and supplies it to an output processing circuit 6 at the next stage.

The read timing signal generating circuit 7 generates various kinds of timing signals to control a discharge light emitting operation and supplies them to a row electrode driving pulse generating circuit 10 and output processing circuit 6, respectively.

Figure 3:
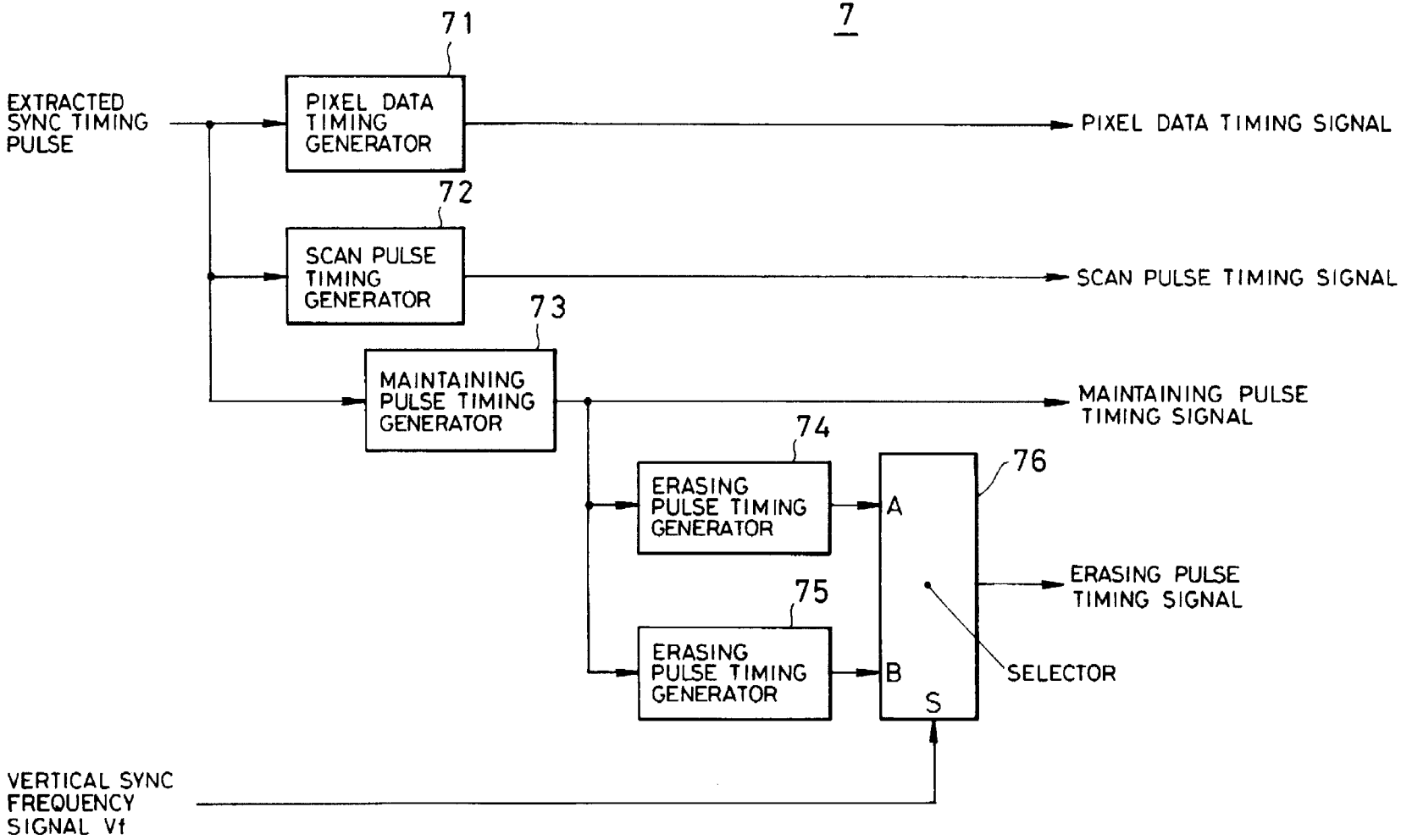
FIG. 3 is a diagram showing an internal construction of a read timing signal generating circuit 7.

FIG. 3 is a diagram showing an internal construction of such a read timing signal generating circuit 7.

In FIG. 3, a pixel data timing generating circuit 71 generates a pixel data timing signal in accordance with the extracted sync signal timing pulse supplied from the timing pulse generating circuit 2 and supplies it to the output processing circuit 6. A scan pulse timing generating circuit 72 generates a scan pulse timing signal in accordance with such an extracted sync signal timing pulse and supplies it to the row electrode driving pulse generating circuit 10. A maintaining pulse timing generating circuit 73 generates a maintaining pulse timing signal in response to the extracted sync signal timing pulse and supplies it to the row electrode driving pulse generating circuit 10.

An erasing pulse timing generating circuit 74 counts the number of pulses of the maintaining pulse timing signal. When the count value reaches a value shown in FIG. 4 every subfield, the erasing pulse timing generating circuit 74 generates an erasing pulse timing signal and supplies it to an input terminal (A) of a selector 76. For example, in execution of the first subfield SF1, when the number of pulses of the maintaining pulse timing signal is equal to 2048, the erasing pulse timing generating circuit 74 generates an erasing pulse timing signal and supplies it to the input terminal (A) of the selector 76. In execution of the second subfield SF2, when the number of pulses of the maintaining pulse timing signal is equal to 1024, the erasing pulse timing generating circuit 74 generates an erasing pulse timing signal and supplies it to the input terminal (A) of the selector 76.

An erasing pulse timing generating circuit 75 also counts the number of pulses of the maintaining pulse timing signal. When the count value reaches a value shown in FIG. 5 every subfield, the generating circuit 75 generates an erasing pulse timing signal and supplies it to an input terminal (B) of the selector 76. Namely, in execution of the first subfield SF1, when the number of pulses of the maintaining pulse timing signal is equal to 1706, the erasing pulse timing generating circuit 75 generates an erasing pulse timing signal and supplies it to the input terminal (B) of the selector 76. In execution of the second subfield SF2, when the number of pulses of the maintaining pulse timing signal reaches 853, the generating circuit 75 generates an erasing pulse timing signal and supplies it to the input terminal (B) of the selector 76.

When the vertical sync frequency signal Vf supplied from the vertical sync frequency measuring circuit 8 corresponds to 60 Hz, the selector 76 selects the erasing pulse timing signal supplied from the erasing pulse timing generating circuit 74, from among the erasing pulse timing generating circuits 74 and 75, and supplies it to the row electrode driving pulse generating circuit 10. On the other hand, when the vertical sync frequency signal Vf corresponds to 72 Hz, the selector 76 selects the erasing pulse timing signal supplied from the erasing pulse timing generating circuit 75 and supplies it to the row electrode driving pulse generating circuit 10.

The row electrode driving pulse generating circuit 10 generates various kinds of driving pulse signals such as scan pulse SP to start the discharge light emission, maintaining pulses IA and IB to maintain a discharge state, and erasing pulse EP to stop the discharge light emission. The generating circuit 10 applies those pulses to row electrodes $Y_1, Y_2, \ldots, Y_n$ and $X_1, X_2, \ldots, X_n$ of a PDP (plasma display panel) 11 in response to the various timing signals supplied from the read timing signal generating circuit 7.

The output processing circuit 6 weights one-field pixel data at eight stages in the luminance component for every pixel data of each field of data supplied, thereby separating the pixel data into first mode pixel data through eighth mode pixel data, respectively. In this instance, such a first mode pixel data corresponds to the highest luminance component. As the degree of the mode rises, a weight of the high luminance component decreases. Namely, the eighth mode pixel data corresponds to the lowest luminance component in the 1-field video signal. The output processing circuit 6 sequentially supplies the first to eighth mode pixel data to a pixel data pulse generating circuit 12 synchronously with the extracted sync signal timing pulse from the timing pulse generating circuit 2.

The pixel data pulse generating circuit 12 generates a pixel data pulse having a voltage value corresponding to logic "1" or "0" of the pixel data in each of the first to eighth mode pixel data supplied from the output processing circuit 6 and divides the pixel data pulse every row. The pixel data pulse of every row divided is applied in a time-division manner to column electrodes $D_1, D_2, \ldots, D_{m-1}$, and $D_m$ the PDP 11.

The driving operation of the PDP 11 in such a plasma display apparatus will now be described with reference to FIG. 6.

Figure 6:
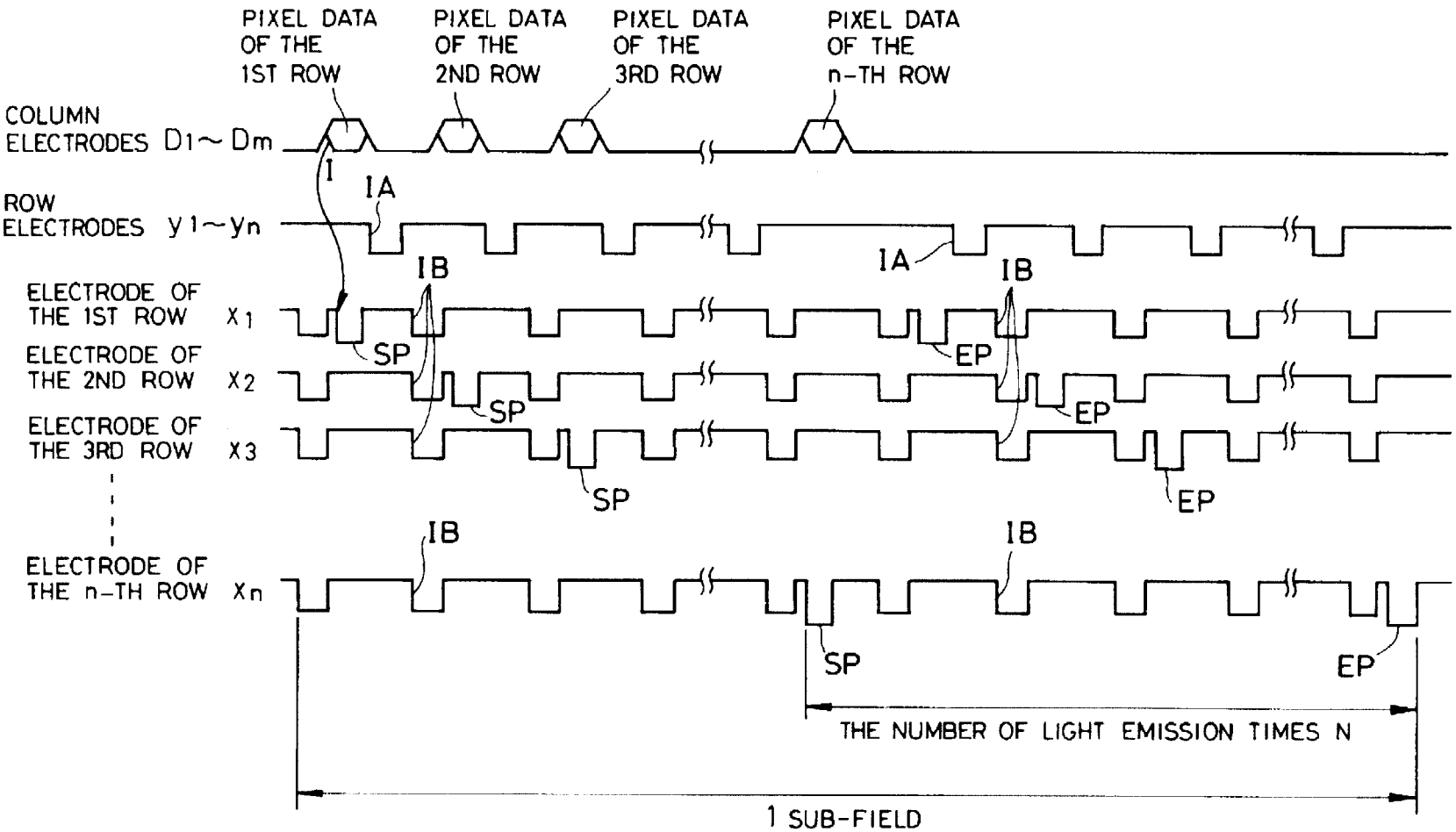
FIG. 6 is a diagram showing operation waveforms by the plasma display apparatus adapted to multiple scanning frequencies according to the invention.

In FIG. 6, the scan pulse SP is applied to the electrode $X_1$ of the first row to the $X_n$ of the n-th row while sequentially shifting its timing. In this instance, the first-row pixel data pulse to the n-th row pixel data pulse are sequentially applied to the column electrodes $D_1$ to $D_m$ at the same timing as the applying timing of the scan pulse SP to each of the row electrodes. A discharge light emission occurs at the row in which the scan pulse SP and the pixel data pulse are simultaneously applied. After that, although the light emitting state by such a discharge light emission is terminated, by alternately applying the maintaining pulses IA and IB to the row electrodes $Y_1$ to $Y_n$ and $X_1$ to $X_n$, the discharge light emission repetitively occurs and the light emitting state is maintained. After that, the discharge light emission is stopped by applying the erasing pulse EP. An apparent luminance can be expressed by the number (N) of times of the light emission which occurred for a period of time from a time point when the scan pulse SP was applied to a time point when the erasing pulse EP is applied. Namely, as such a number of light emission times (N) grows larger, the apparent luminance rises. On the other hand, if the number of light emission times (N) is small, the apparent luminance decreases.

The timing to apply the erasing pulse EP is adjusted by a block constructed by the erasing pulse timing generating circuits 74 and 75 and selector 76 shown in FIG. 3. In this instance, since the number of light emission times (N) is determined by such an applying timing of the erasing pulse EP, the block comprising the erasing pulse timing generating circuits 74 and 75 and selector 76 can be regarded as a circuit to adjust the number of times of the discharge light emission. Such a discharge light emission number adjusting circuit adjusts the number of times of the discharge light emission on the basis of the vertical sync frequency of the supplied video signal and the kind of subfield that is being executed.

A display operation of 256 luminance gradations by the multiple scanning frequency adaptive type plasma display apparatus of the invention shown in FIG. 2 will now be described.

First, the case where the video signal of the vertical scan frequency of 60 Hz is supplied to the plasma display apparatus adapted to multiple scanning frequencies will now be described.

In this instance, the vertical sync frequency measuring circuit 8 supplies the vertical sync frequency signal Vf corresponding to 60 Hz to the read timing signal generating circuit 7. Due to the signal Vf corresponding to 60 Hz, the selector 76 in the read timing signal generating circuit 7 selects the erasing pulse timing signal supplied from the erasing pulse timing generating circuit 74 as opposed to that from the erasing pulse timing generating circuit 75 and supplies it to the row electrode driving pulse generating circuit 10. As mentioned above, the erasing pulse timing generating circuit 74 counts the number of pulses of the maintaining pulse timing signal and generates the erasing pulse timing signal when the count value reaches the value shown in FIG. 4 every subfield.

Figure 7:
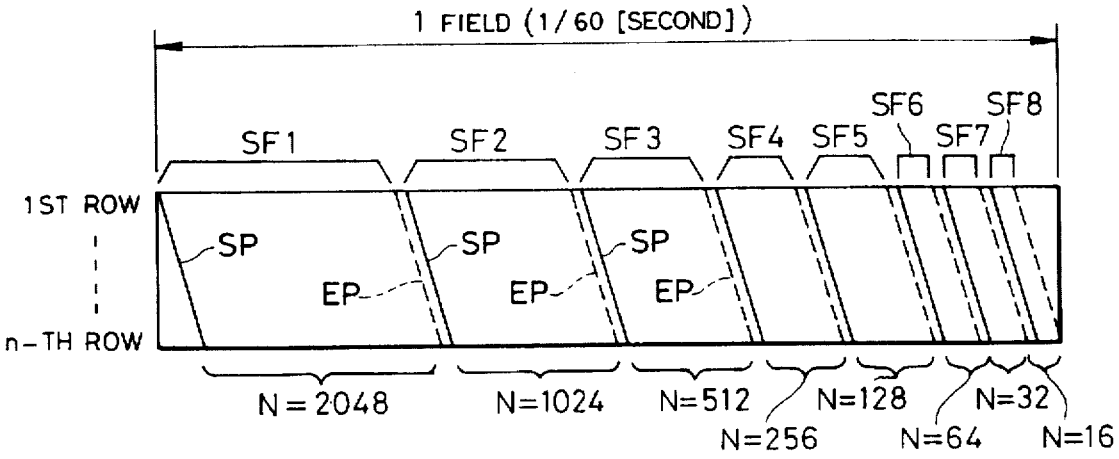
FIG. 7 is a diagram for explaining the display operation of 256 luminance gradations in the case where a video signal having a vertical scan frequency of 60 Hz is supplied.

In the case where the video signal of the vertical scan frequency of 60 Hz is supplied, therefore, the gradation display operation is executed as shown in FIG. 7.

As shown in FIG. 7, in this instance, one field period of the supplied video signal, namely, 1/60 second is divided into eight subfields of the first to eighth subfields SF1 to SF8.

First, in the first subfield SF1, the driving operation as shown in FIG. 6 mentioned above is executed by using the first mode pixel data corresponding to the highest luminance component produced by the output processing circuit 6. In this instance, in such a first subfield SF1, the erasing pulse EP is applied at the timing when the number of light emission times (N) is equal to 2048. In the second subfield SF2, subsequently, the driving operation as shown in FIG. 6 mentioned above is executed by using the second mode pixel data of a low luminance that is lower than that of the first mode pixel data by one rank. At this time, in such a second subfield SF2, the erasing pulse EP is applied at the timing when the number of times (N) of light emission is equal to 1024. In the next third subfield SF3, the driving operation as shown in FIG. 6 mentioned above is executed by using the third mode pixel data of a low luminance that is lower than that of the second mode pixel data by one rank. At this time, in the third subfield SF3, the erasing pulse EP is applied at the timing when the number of times (N) of light emission is equal to 512.

As shown in FIG. 7, in a manner similar to the above, by executing the discharge light emitting operation for the fourth to eighth subfields SF4 to SF8 while reducing the number of times (N) of light emission step by step, the display operation of 256 luminance gradations of one field of the pixel data is executed.

In this case, since the total number of light emission times for such one-field period, namely, 1/60 second is equal to 4080, the number of light emission times per unit time is equal to about 245 times/millisecond.

A case where a video signal of a vertical scan frequency of 72 Hz is applied to such a plasma display apparatus adapted to multiple scanning frequencies will now be described.

In this instance, the vertical sync frequency measuring circuit 8 supplies the vertical sync frequency signal Vf corresponding to 72 Hz to the read timing signal generating circuit 7. The selector 76 in the read timing signal generating circuit 7, therefore, selects the erasing pulse timing signal supplied from the erasing pulse timing generating circuit 75 from among those output by the erasing pulse timing generating circuits 74 and 75 and supplies the selected signal to the row electrode driving pulse generating circuit 10. As mentioned above, the erasing pulse timing generating circuit 75 counts the number of pulses of the maintaining pulse timing signal and generates the erasing pulse timing signal when the count value is equal to a value shown in FIG. 5 every subfield.

Figure 8:
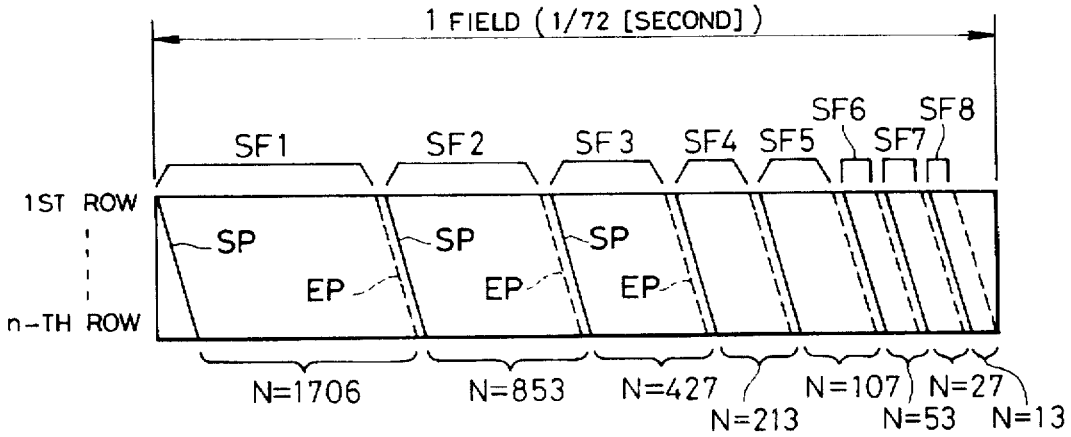
FIG. 8 is a diagram for explaining the display operation of 256 luminance gradations in the case where a video signal having a vertical scan frequency of 72 Hz is supplied.

When the video signal of the vertical scan frequency of 72 Hz is supplied, therefore, the gradation display operation as shown in FIG. 8 is executed.

As shown in FIG. 8, in this instance, one-field period of the supplied video signal, namely, 1/72 second is divided into eight subfields of the first to eighth subfields SF1 to SF8.

First, in the first subfield SF1, the driving operation as shown in FIG. 6 mentioned above is executed by using the first mode pixel data corresponding to the highest luminance component produced by the output processing circuit 6. In this instance, in such a first subfield SF1, the erasing pulse EP is applied at the timing when the number of times (N) of light emission is equal to 1706. In the next second subfield SF2, the driving operation as shown in FIG. 6 mentioned above is executed by using the second mode pixel data of a low luminance that is lower than that of the first mode pixel data by one rank. At this time, in such a second subfield SF2, the erasing pulse EP is applied at the timing when the number of times (N) of light emission is equal to 853. In the third subfield SF3, the driving operation as shown in FIG. 6 mentioned above is executed by using the third mode pixel data of a low luminance that is lower than that of the second mode pixel data by one rank. In this instance, in such a third subfield SF3, the erasing pulse EP is applied at the timing when the number of times (N) of light emission is equal to 427.

As shown in FIG. 8, in a manner similar to the above, by executing the discharge light emitting operation for the fourth to eighth subfields SF4 to SF8 while reducing the number of times (N) of light emission step by step, the display operation of 256 luminance gradations in one field of the pixel data is executed.

At this time, since the total number of light emission times in such a one-field period, namely, 1/72 second is equal to 3399, the number of light emission times per unit time is equal to 245 times/millisecond.

As described above, even in the case where the vertical scan frequency of the video signal supplied is equal to either 60 Hz or 72 Hz, the number of light emission times per unit time is equal to 245 times/millisecond, so that the apparent luminance is held.

Although the above embodiment has been described with respect to the case where the apparatus is made adaptive to a video signal having a vertical scan frequency of 60 Hz or 72 Hz by using the discharge light emission number adjusting circuit comprising the erasing pulse timing generating circuits 74 and 75 and selector 76, the invention is not limited to such a construction.

In brief, as such a discharge light emission number adjusting circuit, it is sufficient to use an adjusting circuit which can adjust the number of times of the discharge light emission of the PDP in accordance with the vertical sync frequency of the video signal which is presumed. In this instance, such a discharge light emission number adjusting circuit adjusts so as to set the number of light emission times per unit time to be constant, to set the number of times of the discharge light emission to a small value in case of a high vertical sync frequency, and to set the number of times of the discharge light emission to a large value in case of a low vertical sync frequency. As mentioned above, in the plasma display apparatus adapted to multiple scanning frequencies according to the invention, the number of times of the discharge light emission of the plasma display panel is reduced or increased in accordance with a respective increase or decrease in vertical sync frequency of the video signal supplied.

According to such a plasma display apparatus adapted to multiple scanning frequencies according to the present invention, therefore, even when the vertical sync frequency of the video signal supplied changes, since the luminance of the whole display image is held constant, a stable display image can be provided, which is a distinct improvement over the conventional art.

What is claimed is:

1. A plasma display apparatus adapted to multiple scanning frequencies, in which a video signal is converted to a plurality of pixel data according to a luminance level for every field of said video signal, the number of times of discharge light emission corresponding to each of said pixel data is set in accordance with said luminance level, and a light emission drive is performed, thereby executing a gradation display, said apparatus comprising:

vertical sync frequency measuring means for measuring a vertical sync frequency of said video signal; and discharge light emission adjusting means for adjusting the number of times of said discharge light emission on the basis of said vertical sync frequency measured, wherein said discharge light emission adjusting means reduces said number of times of said discharge light emission when said vertical sync frequency increases and increases said number of times of said discharge light emission when said vertical sync frequency decreases.

* * * * *